United States Patent [19]

Momose et al.

[11] Patent Number: 4,532,771

[45] Date of Patent: Aug. 6, 1985

[54] COOLER MADE OF ALUMINUM FOR STIRLING ENGINES

[75] Inventors: Yutaka Momose, Anjyo; Kazuaki Yamaguchi, Kariya; Masayoshi Okamoto, Oyama; Ryoichi Hoshino, Oyama; Hiroki Tanaka, Oyama, all of Japan

[73] Assignees: Showa Aluminum Corporation, Osaka; Aisin Seiki Co., Ltd., Aichi, both of Japan

[21] Appl. No.: 518,031

[22] Filed: Jul. 28, 1983

[30] Foreign Application Priority Data

Jul. 30, 1982 [JP] Japan ..... 57-133902

[51] Int. Cl.[3] ..... F25B 9/00

[52] U.S. Cl. ..... 62/6; 60/520; 165/109 T; 165/171

[58] Field of Search ..... 62/6, 515; 60/517, 518, 60/519, 520; 165/109 T, 151, 158, 159, 179

[56] References Cited

U.S. PATENT DOCUMENTS 2,410,180 10/1946 Perkins ..... 165/151

3,508,608 4/1970 Roe ..... 165/179

*Primary Examiner*—Ronald C. Capossela

*Attorney, Agent, or Firm*—Armstrong, Nikaido, Marmelstein & Kubovcik

[57] ABSTRACT

A cooler made of aluminum for use in Stirling engines comprises a multiplicity of cooling tubes, a pair of headers joined to opposite ends of the cooling tubes, inner fins provided in the interior of the cooling tubes, a multiplicity of plate fins intersecting and attached to the group of cooling tubes, and a shell surrounding the cooling tubes and the plate fins. The shell is joined to the headers and has an inlet and an outlet for cooling water.

4 Claims, 6 Drawing Figures

COOLER MADE OF ALUMINUM FOR STIRLING ENGINESc1 BACKGROUND OF THE INVENTION

The present invention relates to a cooler made of aluminum for use in Stirling engines.

The term "aluminum" as used herein and in the claim includes pure aluminum and aluminum alloys.

The Stirling engine is generally widely known. It is an external-combustion engine which uses helium, hydrogen or the like as the working fluid and in which the working fluid is heated and cooled to derive power. The working fluid, which is enclosed in the main body of the Stirling engine, repeats the cycle of being heated with natural gas, kerosene or like combustion gas in a heater, performing the mechanical work of moving a piston, releasing heat to cooling water in a cooler and returning to the heater again. Such Stirling engines achieve a high thermal efficiency and savings in energy and have therefore been introduced into use with continued research efforts. Since helium or like working fluid is enclosed in the engine main body at a high pressure usually of 100 to 200 kg/cm$^2$ G in view of efficiency, the cooler must be resistant to the pressure.

FIG. 5 shows a conventional cooler 21 for Stirling engines which comprises a multiplicity of cooling stainless steel tubes 22 for passing the working fluid therethrough, and headers 23, 24 similarly made of stainless steel and joined to opposite ends of the cooling tubes 22, for example, by TIG arc welding. However, the conventional cooler 21 has the following problems.

(1) The cooler 21, which is made entirely of stainless steel, is heavy.

(2) The cooling tubes 22 are made of stainless steel and are accordingly low in heat transfer efficiency.

(3) The cooler is costly to make because the multiplicity of cooling tubes 22 must be individually welded to the headers 23, 24 by a very cumbersome procedure which requires much labor.

(4) A clearance inevitably occurs between opposite ends of the cooling tubes 22 and the headers 23, 24 thus welded together, resulting in the likelihood that corrosion will develop from the clearance.

It appears possible to fabricate a lightweight cooler of conventional construction with use of aluminum. FIG. 6 shows such a cooler. Aluminum cooling tubes 32 have low strength, whereas the cooler 31 is internally held at a high pressure, which acts on headers 33, 34 at the upper and lower ends of the cooling tubes 32 to produce compressive stress in the tubes 32. Consequently the cooling tubes 32 are buckled and warped laterally.

SUMMARY OF THE INVENTION

The main object of the invention is to provide a cooler made of aluminum for use in Stirling engines which is free of the foregoing problems.

The aluminum cooler of the present invention is characterized in that it comprises a multiplicity of cooling tubes, a pair of headers joined to opposite ends of the cooling tubes respectively, inner fins provided in the interior of the cooling tubes, a multiplicity of plate fins intersecting and attached to the group of cooling tubes, and a shell surrounding the cooling tubes and the plate fins, joined to the headers and having an inlet and an outlet for cooling water.

According to the present invention, the cooler is made of aluminum in its entirety and is therefore very lightweight. Because the multiplicity of cooling tubes for passing helium or like working fluid therethrough are made of highly heat-conductive aluminum and provided with the inner fins and plate fins which are also made of aluminum, the cooler achieves a very high heat transfer efficiency, i.e., outstanding cooling efficiency. Further because the multiplicity of plate fins intersect, and are attached to, the group of cooling tubes, with a shell surrounding the assembly of tubes and plate fins, the cooling tubes are laterally supported by the plate fins and thereby prevented from deformation due to buckling. Thus the cooler has high strength. Since the components of the cooler are all of aluminum, the components can be united into an assembly by a very simple single process, for example, by vacuum brazing without necessitating the cumbersome welding procedure conventionally needed. The cooler is therefore very inexpensive to fabricate. Furthermore, the vacuum brazing process resorted to has the advantage that no clearance occurs between the headers and the aluminum cooling tube ends, eliminating the likelihood of corrosion developing from clearances unlike the conventional procedure.

DESCRIPTION OF THE PREFERRED EMBODIMENT

Figure 1:
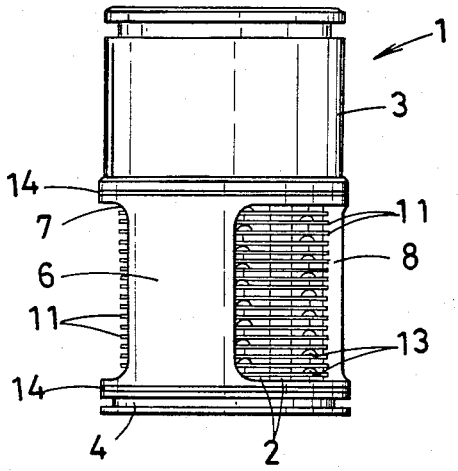
FIG. 1 is a side elevation showing an embodiment of the present invention.
Figure 2:
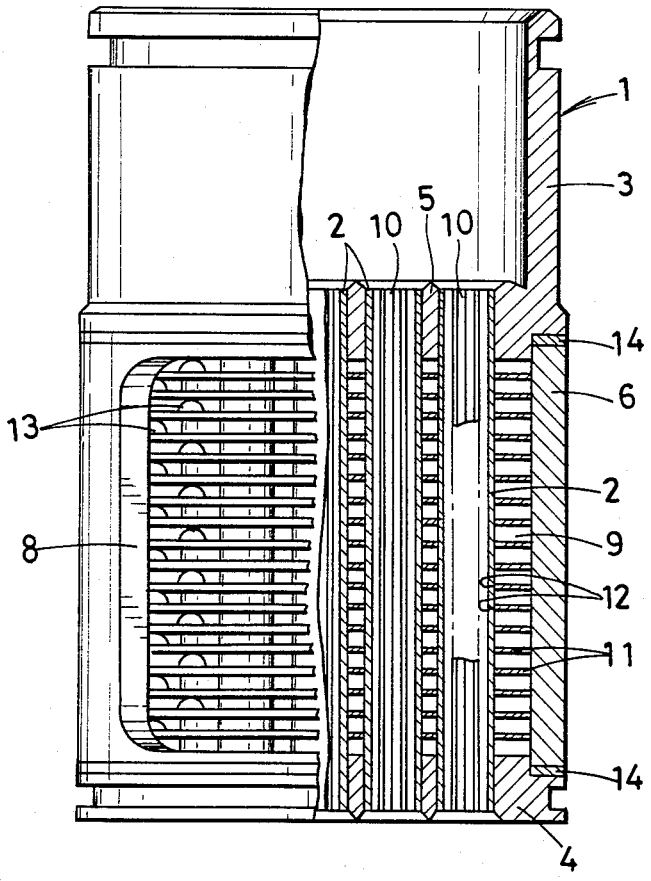
FIG. 2 is an enlarged side elevation partly broken away and showing the same.
Figure 3:
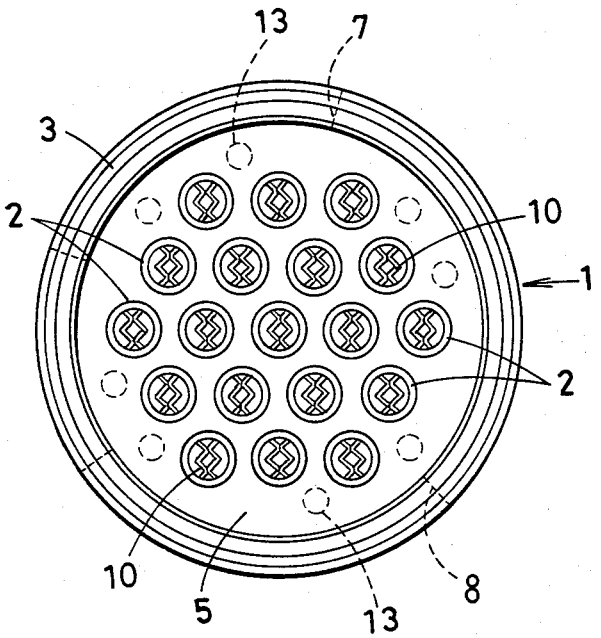
FIG. 3 is an enlarged plan view of the same.

With reference to FIGS. 1 to 4, a cooler 1 of the present invention for use in Stirling engines is made entirely of aluminum. A multiplicity of vertical cooling tubes 2 for passing helium, hydrogen or like working fluid therethrough have upper and lower ends which are joined to a pair of headers 3 and 4 respectively. The upper header 3 is in the form of a bottomed cylinder having a bottom wall 5 to which the upper ends of the cooling tubes 2 are joined. The lower header 4 is in the form of a disk having the lower ends of the cooling tubes 2 attached thereto. A shell 6 substantially in the form of a hollow cylinder surrounds the cooling tubes 2 and is joined to the upper and lower headers 3 and 4. The shell 6 is formed with an inlet 7 and an outlet 8 for cooling water and defines inside thereof a water passing space 9. A pair of inner fins 10, W-shaped in cross section, is provided in the interior of each cooling tube 2. The inner fins 10 are arranged as opposed to each other and extend longitudinally of the tube 2. A multiplicity of plate fins 11, which are circular when seen from above, are arranged horizontally within the water passing space 9 inside the shell 6 as spaced apart from one another at a predetermined distance. The cooling tubes 2 are inserted through a multiplicity of holes 12 formed in the plate fins 11. The plate fins 11 intersect, and are attached to, the group of cooling tubes 2. Each plate fin 11 has four semispherical spacing projections 13. A ring 14 of aluminum brazing sheet is interposed between the upper and lower ends of the shell 6 and the headers 3, 4, whereby the shell 6 is connected to the headers 3, 4.

The components of the aluminum cooler 1 are united into an assembly by vacuum brazing. All the components may be members clad with a brazing material, but it is preferable to use the following materials. Firstly, aluminum pipes clad with a brazing material over the inner and outer surfaces are useful as the cooling tubes 2. In this case, the headers 3, 4 and the fins 10, 11 need not always be members clad with brazing material but may be usual aluminum members. Secondly, aluminum brazing sheets are used as the inner fins 10 and the plate fins 11, while members clad with brazing material are used as the headers 3, 4. In this case, the cooling tubes 2 need not always be the above-mentioned clad pipes but may be usual aluminum pipes. Thirdly, when pipes clad with brazing material over the outer surface only are used as the cooling tubes 2, brazing sheets are used as the inner fins 10. In this case, the headers 3, 4 and the plate fins 11 need not always be members clad with brazing material but can be those of usual aluminum. While the shell 6 is usually connected to the upper and lower headers 3, 4 by the rings 14 of aluminum brazing sheet, the rings 14 can be dispensed with when members clad with brazing material are used as the headers 3, 4.

Figure 4:
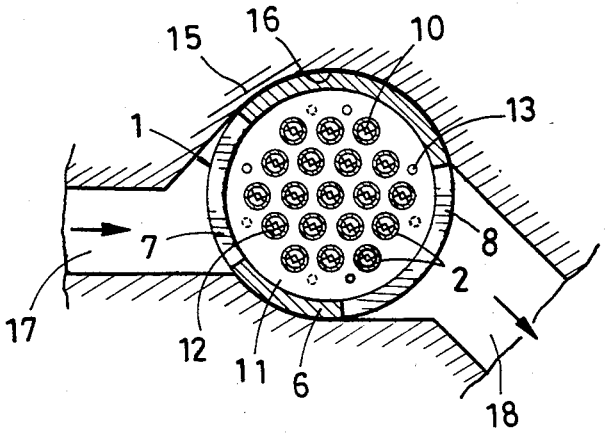
FIG. 4 is a plan view showing the same in use.
Figure 5:
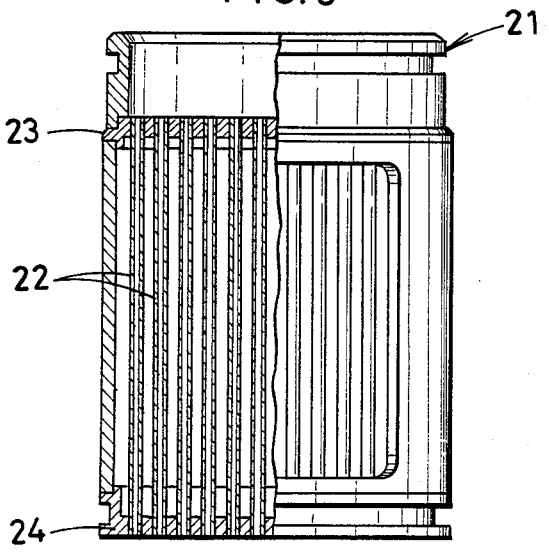
FIG. 5 is a side elevation partly in vertical section and schematically showing a conventional product.
Figure 6:
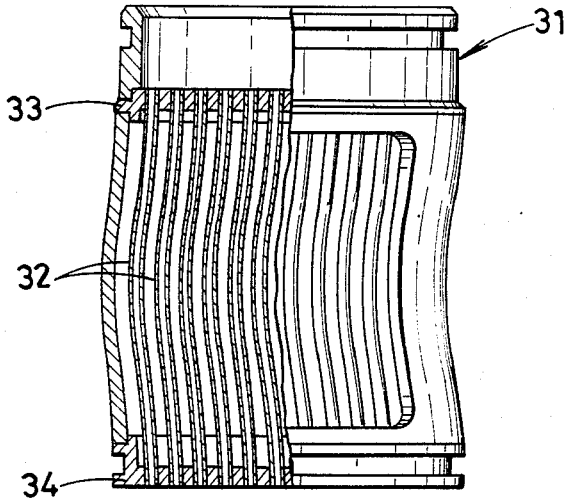
FIG. 6 is a side elevation partly in vertical section and schematically showing a conventional product made of aluminum and as buckled.

The cooler 1 is liquid-tightly fitted in an accommodating space 16 formed in the cast main body 15 of a Stirling engine as seen in FIG. 4. The engine main body 15 is formed, on opposite sides of the cooler 1, with water channels 17, 18 communicating with the cooling water inlet and outlet 7, 8 and water passing space 9 of the shell 6. While passing through the multiplicity of cooling tubes 2, helium or like working fluid releases heat or is cooled through heat exchange with the external water.

Because the multiplicity of cooling tubes 2 themselves are made of highly heat-conductive aluminum and are provided with the inner fins 10 and the plate fins 11 which are also made of aluminum, the cooler 1 achieves a very high heat transfer efficiency. Although the cooler 1 is internally subjected to a high pressure, the shell 6 withstands the pressure acting on the upper and lower headers 3, 4, while the multiplicity of parallel plate fins 11 intersecting and attached to the group of cooling tubes 2 are in contact with the inner wall of the shell 6 at their outer peripheries to laterally support the tubes 2, thus preventing the cooling tubes 2 from warping due to buckling and affording increased strength against buckling.

Although two inner fins 10 W-shaped in cross section are internally attached to each cooling tube 2 according to the foregoing embodiment, a desired number of inner fins 10, which can be cross-shaped, V-shaped or otherwise shaped, are of course usable. The plate fins 11, which are circular, may be in some other shape. To prevent the buckling of the cooling tubes 2, however, the plate fins 11 are preferably so shaped as to position substantially along the inner wall of the shell 6.

The present invention may be embodied differently without departing from the spirit and basic features of the invention. Accordingly the embodiment herein disclosed is given for illustrative purposes only and is in no way limitative. It is to be understood that the scope of the invention is defined by the appended claim rather than by the specification and that various alterations and modifications within the definition and scope of the claim are included in the claim.

What is claimed is:

1. A heat exchange apparatus made substantially of aluminum to cool a working medium under high pressure, comprising:

(a) a multiplicity of cooling tubes for conducting a working medium, (b) a pair of headers joined to opposite ends of said cooling tubes respectively, (c) inner fins disposed longitudinally along the inner walls of said tubes, (d) a multiplicity of plate fins intersecting and attached to the cooling tubes at spaced distances along the outer walls of said tubes, (e) a shell surrounding the tubes and plate fins, joined to the headers to provide a closed cooling area, and (f) an inlet and an outlet through said shell for passage of cooling water.

2. A heat exchange apparatus as claimed in claim 1, wherein said inlet and outlet extend for substantially the same distance as said multiplicity of plate fins.

3. A heat exchange apparatus as defined in claim 1 wherein the multiplicity of plate fins are in contact with the inner wall of the shell at their outer peripheries.

4. A heat exchange apparatus as defined in claim 1 wherein each plate fin has spacing projections, the ends of the spacing projections being in contact with the adjacent plate fins.

* * * * *